United States Patent [19]

Spoeler et al.

[11] Patent Number: 4,706,782

[45] Date of Patent: Nov. 17, 1987

[54] LIFTING AND LOWERING A RAIL SECTION

[75] Inventors: Johannes-Gerhard Spoeler, Borken; Heinz-Uwe Janssen, Schwerte, both of Fed. Rep. of Germany

[73] Assignee: Mannesmann AG, Duesseldorf, Fed. Rep. of Germany

[21] Appl. No.: 850,864

[22] Filed: Apr. 11, 1986

[30] Foreign Application Priority Data

Apr. 16, 1985 [DE] Fed. Rep. of Germany ..... 3513594
Feb. 21, 1986 [DE] Fed. Rep. of Germany ..... 3606070

[51] Int. Cl.[4] ..... B66B 1/00; B66B 5/16; B61B 3/00

[52] U.S. Cl. ..... 187/20; 187/28; 187/76; 187/80; 104/127

[58] Field of Search ..... 187/75, 76, 92, 71, 187/73, 80, 81, 28, 32, 33, 20, 27; 104/127-129; 182/209, 212; 414/607, 608; 211/208, 209; 292/218

[56] References Cited

U.S. PATENT DOCUMENTS

| | | | |
|---|---|---|---|
| 684,013 | 10/1901 | Warren | 187/76 |
| 1,120,293 | 12/1914 | Ekedahl | 104/129 X |
| 1,703,743 | 2/1929 | Mair | 187/32 X |
| 2,173,289 | 9/1939 | Staley | 187/32 X |
| 2,799,423 | 7/1957 | Kaye | 292/218 X |
| 3,100,029 | 8/1963 | Leo | 187/76 |
| 3,661,412 | 5/1972 | Morris | 292/218 |
| 3,783,792 | 1/1974 | Cullom | 104/128 |
| 4,395,180 | 7/1983 | Magnotte | 104/127 X |

FOREIGN PATENT DOCUMENTS

| | | | |
|---|---|---|---|
| 231739 | 2/1909 | Fed. Rep. of Germany | 104/129 |
| 333012 | 2/1921 | Fed. Rep. of Germany | 104/129 |
| 912746 | 12/1962 | United Kingdom | 187/80 |

*Primary Examiner*—Joseph J. Rolla
*Assistant Examiner*—Nils Pederson
*Attorney, Agent, or Firm*—Ralf H. Siegemund

[57] ABSTRACT

A device for lifting and lowering a rail track section in between two rail tracks mounted in different vertical levels and including an elevator carrying the rail track section is improved by means of a latching structure at each end of that section, each including a rotatable latch element with rounded ends, for cooperating with abutment and counter latch surfaces respectively at ends of the rail tracks, at least an upper one of the tracks has passage ways and openings for the latch element to pass through from below; and the latch elements are keyed together for turning so that they will rest on the respective counter latch surfaces and thereby hold the rail track section in an aligned disposition for one or the other of the two rail tracks.

9 Claims, 14 Drawing Figures

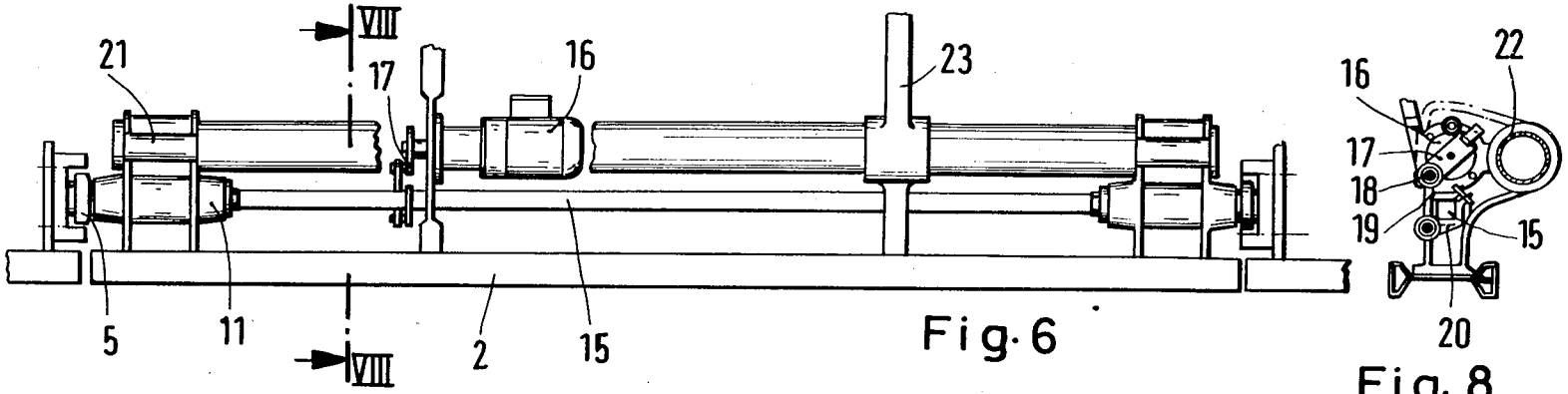
Fig. 8
Fig. 6
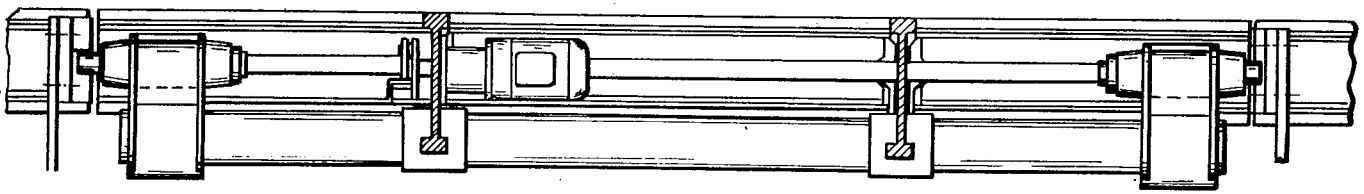
Fig. 7

LIFTING AND LOWERING A RAIL SECTION

BACKGROUND OF THE INVENTION

The present invention relates to lowering and/or lifting a rail track portion or section in between different rail tracks arranged in different vertical levels, to thereby move a rail vehicle from one of these tracks to the other one. The invention is particularly concerned with locking that movable track section to the one or the other track. A station of the type to which the invention pertains is disclosed, for example, in German printed patent application No. 3,241,744. The station is quite expensive, whereby an inherently necessary structure of that station includes a longitudinally movable latch bolt which, in conjunction with associated equipment, is a considerable cost increasing factor. Moreover, turning off this particular station in case of breakdown or other interferences will not occur with absolute certainty, and the avoidance of damage is not guaranteed.

DESCRIPTION OF THE INVENTION

It is an object of the present invention to provide a new and improved lowering and lifting station for vehicles operating in between different levels of rail tracks which overcome the deficiencies of the prior art stations outlined above, and are particularly highly reliable and safe in operation.

It is a particular object of the present invention to provide a new and improved locking structure for rail sections that are to be aligned with tracks operating in different levels.

It is another particular object of the present invention to improve the safety of operation of track section lifting and lowering stations of multi-level track systems.

In accordance with the preferred embodiment of the present invention, it is suggested to provide a particular latch structure by means of which a variably positionable rail track portion can be locked to stationary ones under utilization of an elongated rotating latch element on each end with rounded ends cooperating with curved surface, contour matching abutment and counter latch surfaces pertaining to the stationary track structure, which surface permits passage of the latch element on lowering or lifting of the particular rail track portion to be latched by means of its lateral ends to an upper track. The rotatable latch will be turned by 90 degrees about its longitudinal axis for passing through the aperture which axis runs parallel to that of the movable rail track. Turning of the lock and latch element is simple and guarantees a maximum degree of safety and certainty of operation, particularly because if rounded ends of this element ensure with certainty that the particular movable rail track is placed into the proper position vis-a-vis and in proper alignment with the respective stationary track whenever the matching configuration of the abutting surfaces fits in a snugly fashion.

In practicing the invention it has to be considered of course that the particular rail section that is being lowered and lifted requires latching elements on both ends. Thus, in accordance with a further feature of the invention, these two latch elements have turning shafts that face each other, and are interconnected by means of a common interconnect sleeve, being preferably a polygonal, e.g., square shaped tube that fits over correspondingly contoured keying surfaces of these turning shafts. In order to compensate for any inaccuracies and differences in latching positions at the two ends, particularly in relation to the respective counter latch and support surfaces of the stationary rail track certain attenuating elements in the form of O-rings are provided.. The sleeve or tube interconnecting the two latch turning shafts is driven by a particular motor. This motor is as far as its electrical circuit is concerned, electrically linked with the lifting motor of the station and by means of which the rail section is moved up and down on a carriage. This interconnection of the respective electric circuits ensures that any turning of the latch shafts will occur only when the respective latch elements are safely above the respective engaging surfaces of the respective rail track.

The elevator type carriage is moved by a drive and gear motor in that preferably this motor is linked to the carriage through two tension elements, such as cable or chains. The linkage is not a direct one but through a rocking lever which in turn is connected to a swivel acting as a one-arm lever. In case of straight disposition, the swivel maintains electric current through an emergency circuit breaker to flow through the motor, but in case of undue deflection of the swivel on account of any interference, the emergency circuit breaker stops the drive motor for the carriage. This occurs, for example, if for any reason the cable or chain lengths differ by a particular amount that may be deemed indicative of an emergency situation such as tearing or rupture of one of the cable or the like. The swivel is limited in its deflection through appropriate catches.

In furtherance of the invention, the swivel is a one arm lever linked to one side of the elevator carriage while the aforementioned deflection limiting catches are provided on the other side for respective engagement with the free end of the swivel arm. The swivel may be spring biased, particularly for forcing the swivel always in down direction in order to keep the chains or cable taut. This feature is important particularly in those instances when the rail section has locked in on the stationary rails, the force of the spring should be smaller than the minimum weight of the elevator carriage, and there should be also a buffer in order to prevent rebounding. If the force of the spring is as stated, the swivel will be in the upper abutting position of its free end during normal lifting and lowering and therewith the prime switch for the lowering/lifting motor is maintained in the on position.

DESCRIPTION OF THE DRAWINGS

While the specification concludes with claims particularly pointing out and distinctly claiming the subject matter which is regarded as the invention, it is believed that the invention, the objects and features of the invention, and further objects, features and advantages thereof will be better understood from the following description taken in connection with the accompanying drawings in which:

FIG. 6 is a side elevation of a rail section with latch structure shown in the preceding figures and showing also details of a drive mechanism;

FIG. 7 is a top elevation of the latch structure shown in FIG. 6 and as indicated therein by VII;

FIG. 8 is a section view taken in a plume as indicated by numerals VIII in FIG. 6;

Figure 1:
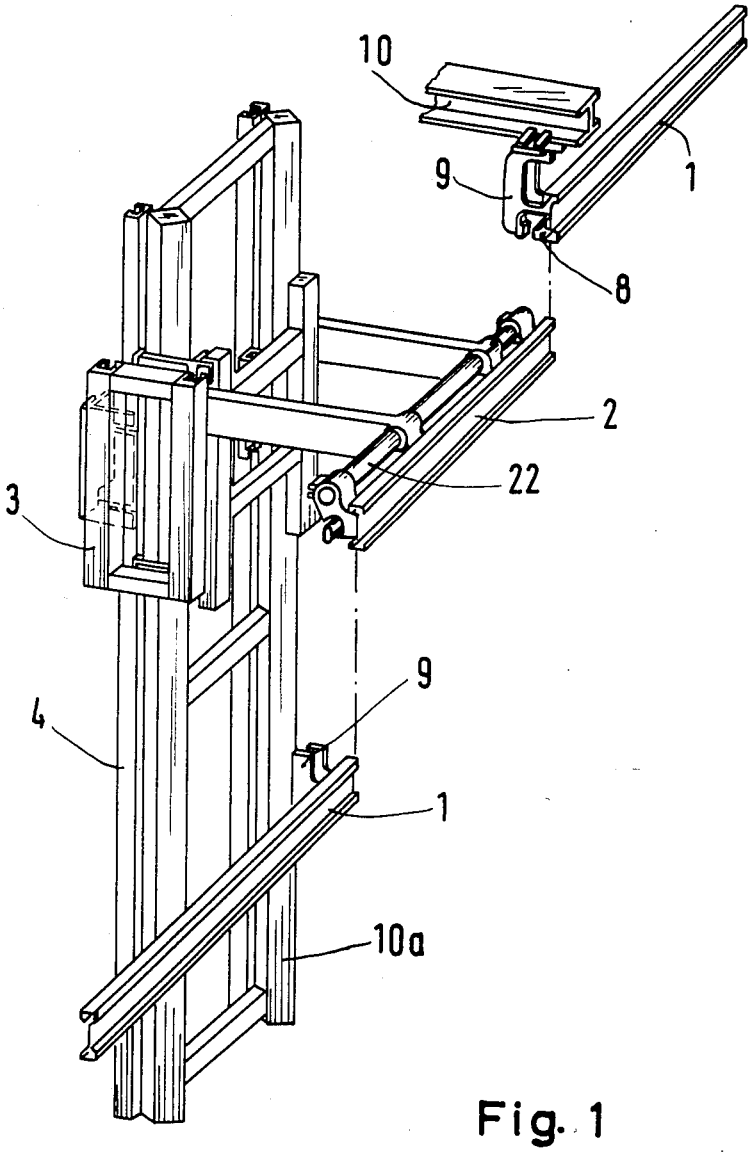
FIG. 1 illustrates a portion of these rail tracks and includes a station for lifting and lowering a rail track, the arrangement being shown in a perspective view and illustrates a preferred embodiment of the present invention for practicing the best mode thereof.

Proceeding now to the detailed description of the drawings, reference is made first to the overall view depicted in FIG. 1 illustrating two tracks 1*a* and 1*b* arranged in different levels for accommodating trolleys, dollies, bogies, and other vehicles running suspended from such overhung rails. Rail track 1*a* particularly continues towards the lower-middle left of FIG. 1 but has been omitted for the sake of clarity. The continuation can be taken from FIGS. 6 and 7. A particular short rail section 2 is provided for raising and lowering and particularly for purposes of being aligned either with upper rail track 1*a* or at a lower level with rail track 1*b*. It is assumed that in some cases (many, all) a bogie or other vehicle is suspended from the rail section 2 and is therewith changed as to the track on which it is to run from rail track 1*a* to 1*b* or vice versa. This rail track portion or section 2 is in basically cantilever fashion mounted on a vertical slide or elevator type carriage 3, by means of arms 23, for holding a tube or pipe 22 on which rail section 2 is suspended. The carriage or elevator 3 has side structure 3*b* and 3*c* from which the cantilever suspension arms 23*a* extend. As the carriage 3 moves up and down on vertical pillar or column-like tracks 4, rail section 2 can be lowered or raised therewith. The structure and station is depicted by way of example only, there may be more than two tracks which are, so to speak, indirectly interconnected or operatively interconnectable by means of the lowered or raised section 2. As will become apparent more fully below, an operative difference exists on account of section 2 being placed into alignment with track 1*a* from below, and with track 1*b* from above.

The rail track 2 has at its two oppositely oriented ends flattened, rotatable latches 5 constructed in accordance with the preferred embodiment of the present invention for fixing and arresting the position of the track portion 2 in an exactly aligned relationship either to the track 1*a* or to the track 1*b*. The upper rails 1*a* are at their ends to be connected to rail track section 2, provided with passageways 6 so that the respective flat rotatable latch element can pull through as section 2 is raised. On turning the latch element will snugly fit in pocket-like abutment surfaces forcing the latch element 5 and the rail section 2 to assume an aligned position in relation to track 1*a* (and 1*b* as the case may be, except that no passageway 6 is needed through the respective latch surfaces 7 pertaining to rail 1*b*).

In detail, the latch elements 5 themselves have rounded ends, and they will be received by and very accurately laterally held in matching and mating concave round indents being part of the surfaces 7. This way rail track 2 will always be properly aligned with the respective adjacent rail track 1*a*. The passages 6 as well as the abutment surfaces 7 together establish a kind of thrust mount 8, which in turn is connected to arms 9. These carrier elements 9 are of basically C-shaped configuration and are provided for carrying and mounting the tracks, such as track 1*a*, and for fastening them on elevated beams, support elements, or the like, 10*a* or 10*b*.

Figure 4:
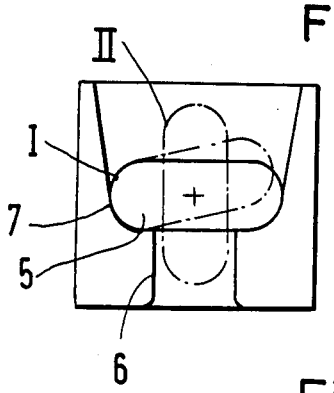
FIG. 4 is a front view of the latch shown in FIGS. 2 and 3.
Figure 2:
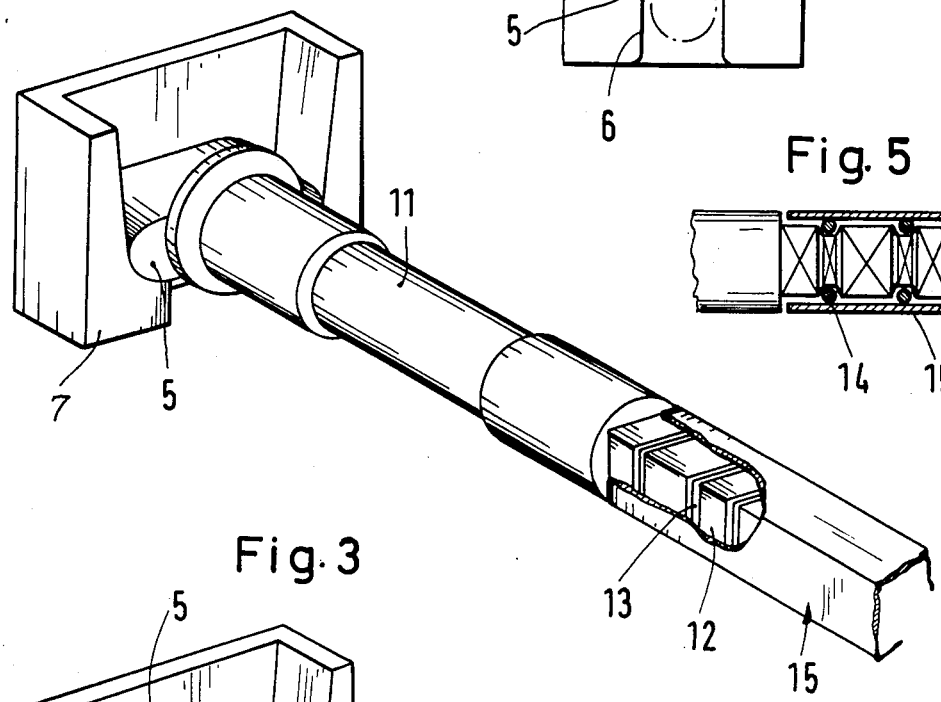
FIG. 2 is a perspective view of a detail, on an enlarged scale, of a portion of the structure shown in FIG. 1, illustrating specifically a latch element in latching position.
Figure 5:
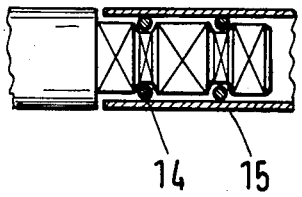
FIG. 5 is a partial section view into a portion of the latch shaft coupling structure shown also in FIG. 2.
Figure 3:
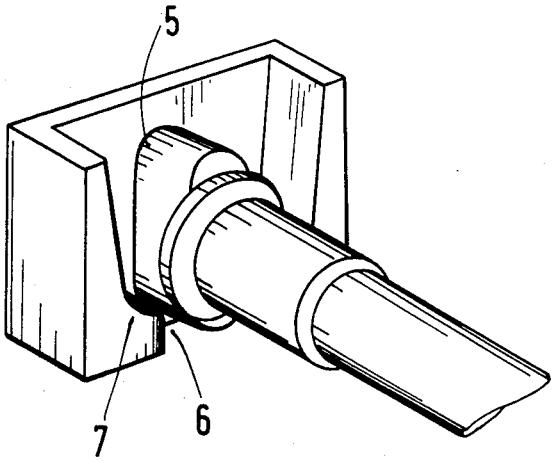
FIG. 3 is a view similar to FIG. 2 but showing the same latch in unlatched position.

FIGS. 2, 3 and 4, as stated, illustrate one of the latch elements 5, whereby particularly the latch element is shown as it is needed for an upper stationary rail track such as 1*a*, towards which the track section 2 is raised from below. Also, as was mentioned above, multi-level track systems may be provided for, so that for example another track is provided below track 1*b*. In this case then, track section 2 is in some instances of operation also raised in towards track 1*b*. All this means, that the stationary counter latch surfaces 7 have to have passageways 6 only if the circumstances are such that the movable rail section 2 can be moved up from below. As to the lowest rail track, this will normally not happen. The latch element 5, however, is basically constructed in the same fashion in all instances.

The latch 5 has a shaft element 11 which is a basic element of rotation. As stated, the track section 2 is provided with two latches at opposite ends and the respective turning shafts point towards each other. A square shaped keying head 12 being provided with grooves extends from each of the shafts 11. The parts 11 and 12 of a shaft are preferably of single piece, uniform or unitary construction and could be made from a particularly hard material such as "spharogus" GGG. The quadrant heads 12 in these turning shafts will be interconnected through a matching tube or sleeve 15 square shaped (internal) cross-section. In order to permit true abutment of the latch element 5 on and in abutment surfaces 7, latch shaft 11 is constructed as coupling element using here the already mentioned quadrant head 12 with groove 13, and round elastic O-ring type elements 14 are inserted in these grooves. These elastic O-rings 14 are provided for yielding in relation to the square shaped tube or sleeve 15 in case of dimensional inaccuracies of the latter so that in each instance the latch elements 5 will actually match exactly the abutment surface 7.

The rectangular connect sleeve on tube 15 is, as shown in FIGS. 6, 7 and 8, connected with a rotational drive 16. This drive 16 rotates the sleeve 11 if and as long as the latch element 5 is disposed above the respective abutment surface 7 so that the dispositional change of latch elements 5 occurs from a vertical passage position particularly through the opening 6, to a horizontal latch position. That latch position is shown specifically in FIG. 2, and also in solid lines in FIG. 4, while the dash dot lines in FIG. 4 indicate alternative positions including the vertical position for passage of the latch elements through the opening 6.

As can be seen from FIGS. 6 and 8, the drive 16 is a gear type motor which is connected to and drives a crank shaft type disc 17 with pin or bolt linked to a rod 19 for connection to a lever 20 which extends from the tube 15 as shown specifically and in greater detail in FIG. 8. This way connect sleeve 15 is turned by 90 degrees as between latching and unlatching positions for both latches 5.

Figure 9:
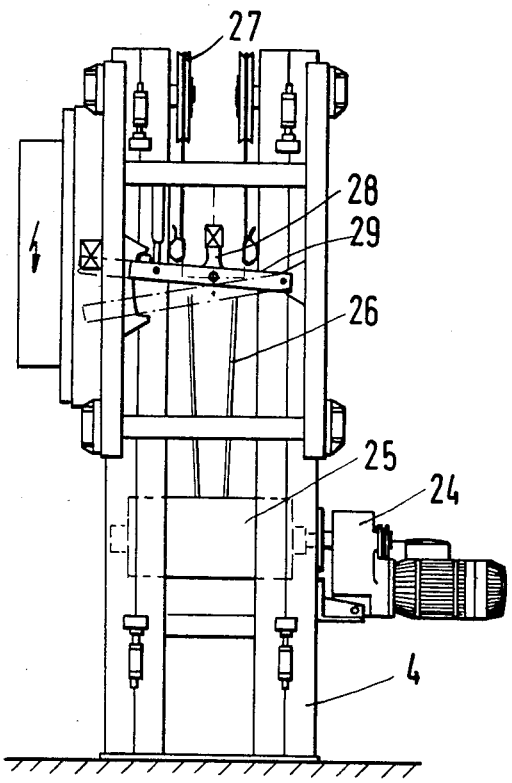
FIG. 9 is a front view of the rail section lifting carriage shown in FIG. 1 and including specifically lifting cables.
Figure 10:
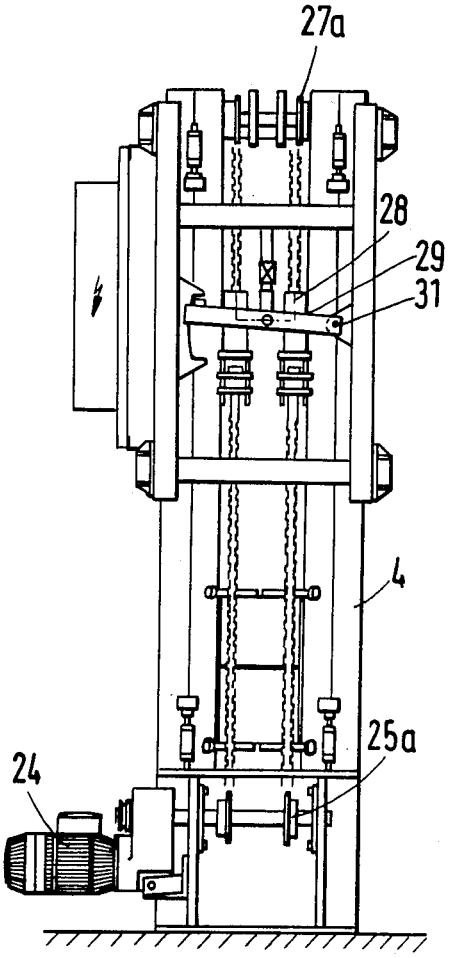
FIG. 10 is a view similar to FIG. 9 including the lifting carriage but showing chains instead of cable.

FIG. 9 illustrates a rear view of the lifting and lowering, i.e., elevator-like carriage 3. This carriage 3 is suspended by means of cable 26. A gear motor 24, which could also be termed a winch motor, drives cable 26 with a drum 25. Cable sheaves 27 run the cable 26 towards a two arm rocker 28. In the case of FIG. 10, the motor 24 drives a pinion 25*a* for chain elements 26*a*, which also in this case run towards the rocker 28 using in this case sprocket wheels 27*a*. The rocker 28, as indicated already in FIGS. 9 and 10, is shown in greater detail in FIGS. 11, 12, 13 and 14 on a larger scale, and therefore is more easily discernible from these figures. This rocker 28 is mounted by means of a forward pin 30 in a swivel-like suspension device 29. This one arm lever is hinged through bearing eyes 31 with and to one side of the elevator carriage 3. A limiting stop 32 is provided for limiting the deflection of the swivel arm 29 and is fastened to the opposite side of carriage 3, opposite the bearing eye 31.

Figure 11:
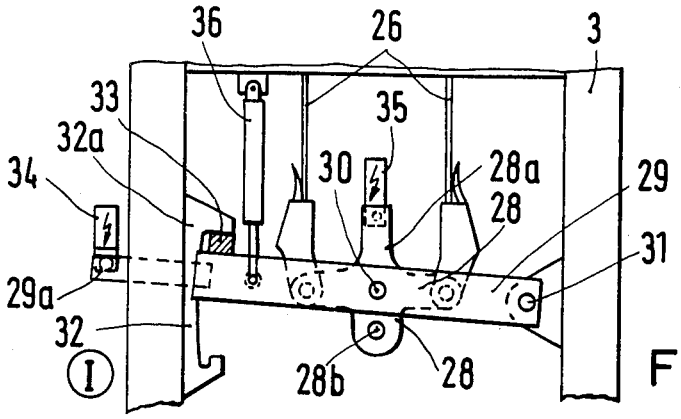
FIGS. 11, 12, 13 and 14 illustrate the lifting carriage of FIGS. 1, 9 and 10 in different positions and conditions of operation, including emergency situations described fully below.

FIG. 11 illustrates specifically the swivel arm 29 during lifting of rail track portion 2 while still being outside of any position of alignment with any track (1*a* or 1*b*). The swivel device 29 as carried through the rocker 28 by means of the cable 26 bears through a buffer stop 33 against an upper stop 32*a* of the deflection limiting device 32. This is the normal operating position for the arm 29. The swivel 29 has an extension 29*a* by means of which it bears against an electric switch 34 being provided for maintaining electric power to the drive motor 24 as long as swivel arm 29 is in the slightly upwardly slanting position.

Figure 12:
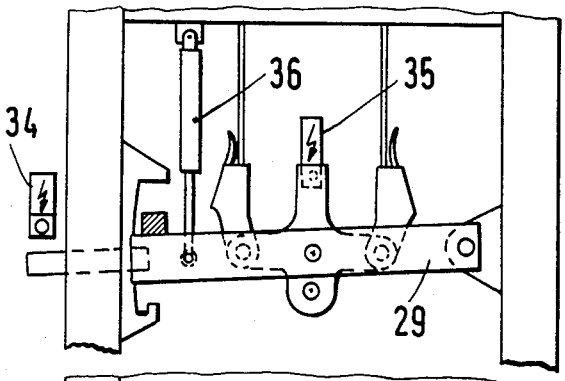

FIG. 12 illustrates the swivel arm 29 when the rail track 22 through its latch element 5 just sits on and bears against supports and latching counter surface 7. The swivel device 29 has now receded from the switch 34 which therefore opened and turned off the motor 24. A spring 36 forces the swivel arm and device 29 in down direction and, therefore, holds the cable taut even if it took a little time for the motor 24 to stop. The force of the spring 36 is smaller than the total weight of the carriage 3 with load so that the carriage will not rebound as the operating state of the motor 24 is changed.

Figure 13:
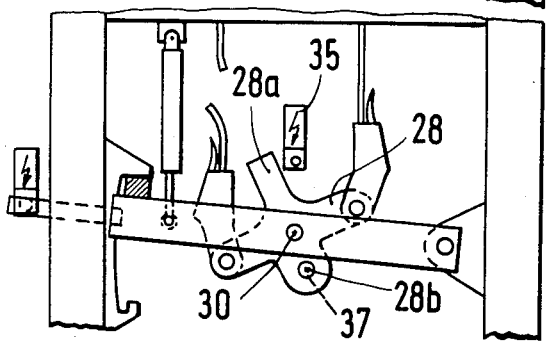

FIG. 13 illustrates the disposition of the swivel arm and device 29 under the same load condition as shown in FIG. 11, but it is assumed that for some reason one of the cable 26 (or in case of a chain suspension of one of the chains such as 26*a* of FIG. 10) has ruptured. In this case the rocker 28 will drop on one side and assume a particular but extraordinary tilted operating condition. The rocker 28 is provided with an upwardly extending switch operating plunger 28*a* which, as long as the rocker 28 has the normal and regular, i.e., balanced operating state, will keep an emergency circuit breaker switch 35 closed and power will be supplied to the motor 24. Now, however, a rupture, or breakage (or chain fracture) has occured as shown. This situation can also be seen an analogous to an undue stretching of the cable or chain, and here then rocker 28 will tilt around the pin 30 and in relation to swivel 29 so that the plunger 28*a* releases the emergency turn off switch on circuit breaker 35, and the latter will with certainty turn off the motor 24. The rocker 28 is provided with a bearing eye 28*b* disposed below the swivel 29, which eye 28*b* is provided with a safety stop pin 37. In the case of an assumed rupture of cable 26 or chain 26*a*, pin 37 limits the tilt angle path of the rocker 28 as is shown specifically in FIG. 13.

Figure 14:
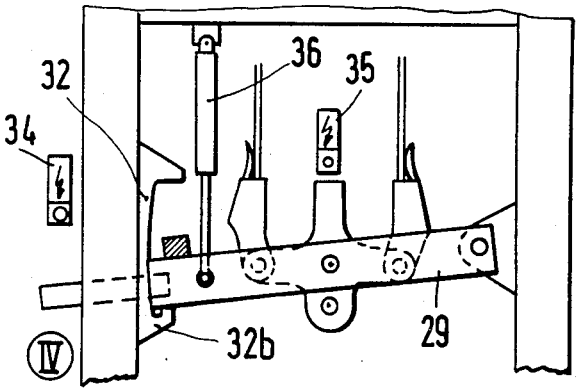

FIG. 14 is comparable with FIG. 12, but it is assumed here that the swivel device 29 has pivoted down to the lowermost position wherein its front end bears against the lower abutment 32*b* of the stop member 32. This situation occurs or could occur whenever the switch 34 has failed to turn off the motor (also the rail section 2 has been latched) or if for any other reason the motor 24 runs too long after a turnoff command. This then may require again intervention by the emergency circuit breaker 35, which prevents also that the motor 24 accidentally or otherwise is turned on again until the problem has been dealt with, that is which mechanical balance of the 3-28-29 has been restored.

The invention is not limited to the embodiments described above, but all changes and modifications thereof not constituting departures from the spirit and scope of the invention are intended to be included.

We claim:

1. A device for lifting and lowering a rail track section in between two rail tracks mounted in different vertical levels and including an elevator type carriage carrying the rail track section; the improvement of a latching structure comprising:

rotatable latch elements with rounded ends and provided on said carriage in the vicinity of the rail section;

abutment and counter latch surfaces respectively at ends of said rail tracks and wherein at least an upper one of said tracks has passage ways and openings for said latch elements to pass through from below; and means for turning the latch elements so that they will rest on the respective counter latch surfaces and thereby hold the rail track section in an aligned disposition for one or the other of the two rail trucks.

2. The improvement as in claim 1 there being two latch elements on the carriage each having a turning shaft, the shafts facing each other and being provided with keying surfaces for being interconnected through a tubular connect element with polygonal cross-sectional configuration, there being resilient means included on the shafts for engaging the tubular connect element from its inside to compensate operative deviations from a true alignment of the shafts

3. The improvement as in claim 2, there being a common drive motor for turning said connect element.

4. The improvement as in claim 1, said carriage including a swivel arm, and means for suspending said carriage by means of two cables or chains.

5. The improvement as in claim 1 there being vertical tracking, said carriage being indirectly suspended from said tracks by means of two cables or chains, affixed to opposite arms of a two arm rocker being journalled on a one arm swivel being pivotably hinged to the carriage while a free arm of the swivel is displaceable between two stop positions.

6. The improvement as in claim 5, said rocker having a pin for limiting deflection of the rocker.

7. The improvement as in claim 5 and including means for spring biasing the swivel arm.

8. The improvement as in claim 5, said chains or cable being connected to and driven by a motor, further including a first switch for the motor closing a circuit for the motor only when the swivel arm is in one stop position.

9. The improvement as in claim 5 including an emergency switch being operated when the rocker assumes an unbalanced position.

* * * * *